US007520274B2

(12) United States Patent
Sawada et al.

(10) Patent No.: US 7,520,274 B2
(45) Date of Patent: Apr. 21, 2009

(54) AIR FUEL RATIO SENSOR DETERIORATION DETERMINATION SYSTEM FOR COMPRESSION IGNITION INTERNAL COMBUSTION ENGINE

(75) Inventors: Hiroshi Sawada, Gotenba (JP); Daisuke Shibata, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 66 days.

(21) Appl. No.: 11/630,863

(22) PCT Filed: Jun. 29, 2005

(86) PCT No.: PCT/JP2005/012441

§ 371 (c)(1),
(2), (4) Date: Dec. 26, 2006

(87) PCT Pub. No.: WO2006/001549

PCT Pub. Date: Jan. 5, 2006

(65) Prior Publication Data

US 2008/0028829 A1 Feb. 7, 2008

(30) Foreign Application Priority Data

Jun. 29, 2004 (JP) ..... 2004-191557

(51) Int. Cl.
*F02D 41/00* (2006.01)
*F01N 3/00* (2006.01)

(52) U.S. Cl. ..... 123/690; 123/672; 60/276; 73/23.32

(58) Field of Classification Search ..... 123/672, 123/676, 688, 690, 691; 60/276, 277, 285; 73/23.31, 23.32, 116, 118
See application file for complete search history.

(56) References Cited

U.S. PATENT DOCUMENTS

| | | | | |
|---|---|---|---|---|
| 5,488,858 | A | 2/1996 | Achleitner | |
| 6,131,446 | A | 10/2000 | Schnaibel et al. | |
| 6,216,448 | B1 | 4/2001 | Schnaibel et al. | |
| 6,244,046 | B1 * | 6/2001 | Yamashita | 60/285 |
| 6,467,471 | B2 * | 10/2002 | Wakui et al. | 123/674 |
| 6,588,251 | B2 | 7/2003 | Zhang et al. | |
| 6,915,203 | B2 * | 7/2005 | Maegawa et al. | 701/114 |
| 7,198,952 | B2 * | 4/2007 | Uchida et al. | 436/37 |

(Continued)

FOREIGN PATENT DOCUMENTS

EP 1 471 238 A2 10/2004

(Continued)

*Primary Examiner*—John T Kwon
(74) *Attorney, Agent, or Firm*—Oliff & Berridge, PLC

(57) ABSTRACT

In a compression ignition internal combustion engine provided with an NOx storage-reduction catalyst on an exhaust system, when the air fuel ratio of the exhaust gas being in a lean state is controlled to a rich state, a response time (ResS) from a time point an air fuel ratio sensor detects a first air fuel ratio (AF1), which is leaner than a stoichiometric air fuel ratio (AFS), to a time point the air fuel ratio sensor detects a second air fuel ratio (AF2), which is equal to or leaner than the stoichiometric air fuel ratio (AFS) and richer than the first air fuel ratio (AF1). When the response time (ResS) exceeds a stoichiometric air fuel ratio shift reference time (StdS), a determination is made that the air fuel ratio sensor is degraded.

8 Claims, 4 Drawing Sheets

U.S. PATENT DOCUMENTS

| | | | | |
|---|---|---|---|---|
| 2001/0006062 | A1* | 7/2001 | Wakui et al. | 123/674 |
| 2002/0038544 | A1* | 4/2002 | Ikemoto et al. | 60/285 |
| 2003/0017603 | A1* | 1/2003 | Uchida et al. | 436/37 |
| 2003/0019485 | A1* | 1/2003 | Kobayashi et al. | 123/672 |
| 2004/0211168 | A1 | 10/2004 | Namiki | |

FOREIGN PATENT DOCUMENTS

| | | |
|---|---|---|
| JP | A 5-125978 | 5/1993 |
| JP | A-05-256175 | 10/1993 |
| JP | A-06-273281 | 9/1994 |
| JP | A 6-346775 | 12/1994 |
| JP | A 7-269400 | 10/1995 |
| JP | A 10-18886 | 1/1998 |
| JP | A 10-280991 | 10/1998 |
| JP | A 2004-3513 | 1/2004 |

* cited by examiner

AIR FUEL RATIO SENSOR DETERIORATION DETERMINATION SYSTEM FOR COMPRESSION IGNITION INTERNAL COMBUSTION ENGINE

TECHNICAL FIELD

The present invention relates to an air fuel ratio sensor deterioration determination system for determining the deterioration of an air fuel ratio sensor arranged in an exhaust passage of a compression ignition internal combustion engine.

BACKGROUND ART

There has been widely known a technology in which an air fuel ratio sensor for generating an air fuel ratio signal corresponding to the oxygen concentration of an exhaust gas is installed on an exhaust system of a compression ignition internal combustion engine, so that the air fuel ratio of the exhaust gas is controlled by adjusting the amount of fuel to be injected from a fuel injection valve and the fuel injection timing thereof, the amount of fuel to be injected directly into the exhaust system from a fuel addition valve or the like.

However, in the air fuel ratio sensor, a protector for the sensor, etc., can be clogged due to particulate materials or the like contained in the exhaust gas, during which the function of the air fuel ratio sensor might be degraded or deteriorated because of a change in the property of electrodes of the sensor due to the thermal deterioration thereof. If the air fuel ratio of the exhaust gas is controlled based on the air fuel ratio signal from the air fuel ratio sensor thus degraded, there will be fear that the actual air fuel ratio of the exhaust gas might become far away from a target air fuel ratio exhaust gas, thereby deteriorating the exhaust emission. Accordingly, as a technique to determine the deterioration of the air fuel ratio sensor, there has been disclosed one in which when the time required of the air fuel ratio sensor from the detection of a predetermined rich-side air fuel ratio until the detection of a predetermined lean-side air fuel ratio or the time required of the air fuel ratio sensor from the detection of a predetermined lean-side air fuel ratio until the detection of a predetermined rich-side air fuel ratio is longer than a reference time, a determination is made that the air fuel ratio sensor is degraded (see, for example, Japanese patent application laid-open No. H10-18886).

In addition, there has also been disclosed a technique in which the deterioration of an air fuel ratio sensor is determined based on the response of the air fuel ratio of an exhaust gas detected by the air fuel ratio sensor, and a reference value for deterioration determination is changed according to the cases where the air fuel ratio of the exhaust gas is at a lean side, or in the vicinity of a stoichiometric air fuel ratio, or at a rich side (see, for example, Japanese patent application laid-open No. H10-280991).

DISCLOSURE OF THE INVENTION

In cases where a so-called NOx storage-reduction catalyst is used as a catalyst for purifying an exhaust gas from a compression ignition internal combustion engine, an air fuel ratio sensor is often arranged at a downstream side of the NOx storage-reduction catalyst so as to avoid undesirable thermal effects, damage and the like. The NOx storage-reduction catalyst has a function of temporarily storing the oxygen or NOx contained in the exhaust gas or releasing the stored oxygen or the like. Accordingly, if a determination as to whether the air fuel ratio sensor is degraded is made based on the response of detection of the air fuel ratio in the air fuel ratio sensor arranged at the downstream side of the NOx storage-reduction catalyst, the influence of the storage function of the NOx storage-reduction catalyst will affect the detection response, thus making it difficult to provide an accurate deterioration determination.

Moreover, in the exhaust system of the compression ignition internal combustion engine, when fuel is added directly to the exhaust system, the molecular weight of fuel contained in the exhaust gas arriving at the air fuel ratio sensor is relatively large. Therefore, there might be a case where a variation arises between the time fuel molecules pass through a diffused resistor layer of the air fuel ratio sensor and the time oxygen molecules pass therethrough, thus making it unable to accurately detect the air fuel ratio of the exhaust gas due to a so-called lean shift or deviation. As a result, when it is determined, based on the response of detection of the air fuel ratio by the air fuel ratio sensor, whether the air fuel ratio sensor is degraded, it becomes difficult to make such an determination in an accurate manner.

In view of the above-mentioned problem, the present invention has for its object to highly accurately perform a deterioration determination of an air fuel ratio sensor, which is arranged at a downstream side of an NOx storage-reduction catalyst, in a compression ignition internal combustion engine provided with the NOx storage-reduction catalyst on an exhaust system.

In the present invention, to solve the above-mentioned problem, firstly, attention is focussed on that when the air fuel ratio of an exhaust gas flowing into an NOx storage-reduction catalyst is shifted from a lean state to a rich state, the air fuel ratio of the exhaust gas detected by an air fuel ratio sensor is temporarily maintained at a value in the vicinity of the stoichiometric air fuel ratio by the storage function of the NOx storage-reduction catalyst. In the process of the air fuel ratio of the exhaust gas being shifted from the lean state to the rich state, by determining the deterioration of the air fuel ratio sensor based on its response to the detection of the air fuel ratio by the air fuel ratio sensor at a time before the air fuel ratio of the exhaust gas is temporarily put into the value in the vicinity of the stoichiometric air fuel ratio by the storage function of the NOx storage-reduction catalyst, it is possible to make a more accurate deterioration determination.

Thus, according to a first aspect of the present invention, there is provided an air fuel ratio sensor deterioration determination system for a compression ignition internal combustion engine comprising: an NOx storage-reduction catalyst arranged on an exhaust passage of the compression ignition internal combustion engine; an air fuel ratio sensor arranged at a downstream side of the NOx storage-reduction catalyst for detecting an air fuel ratio corresponding to an oxygen concentration of an exhaust gas flowing out from the NOx storage-reduction catalyst; an exhaust gas air fuel ratio control section that controls an air fuel ratio of an exhaust gas flowing into the NOx storage-reduction catalyst by supplying fuel to the exhaust gas flowing into the NOx storage-reduction catalyst; a stoichiometric air fuel ratio shift response time detection section that detects a response time from a time point the air fuel ratio sensor detects a first air fuel ratio, which is leaner than a stoichiometric air fuel ratio, to a time point the air fuel ratio sensor detects a second air fuel ratio, which is equal to or leaner than the stoichiometric air fuel ratio and richer than the first air fuel ratio, when the air fuel ratio of the exhaust gas being in a lean state is controlled to a rich state by the exhaust gas air fuel ratio control section; and an air fuel ratio sensor deterioration determination section that makes a determination that the air fuel ratio sensor is degraded, when the response time detected by the stoichiometric air fuel ratio shift response time detection section exceeds a stoichiometric air fuel ratio shift reference time.

In the above compression ignition internal combustion engine, it is possible to control the air fuel ratio of the exhaust gas flowing into the NOx storage-reduction catalyst, for example, by adjusting the amount of fuel to be injected and the timing of fuel injection in each cylinder by means of the exhaust gas air fuel ratio control section, or by adding fuel directly to the exhaust system. As a result, the NOx occluded in the NOx storage-reduction catalyst can be reduced, and the SOx occluded therein can also be released.

Here, when the response time of the air fuel ratio sensor is detected by the stoichiometric air fuel ratio shift response time detection section, the exhaust gas air fuel ratio control section shifts the air fuel ratio of the exhaust gas from a lean state to a rich state. This shift from the lean state to the rich state includes not only a case where a shift is done from a lean-side air fuel ratio leaner than the stoichiometric air fuel ratio to a rich-side air fuel ratio richer than the stoichiometric air fuel ratio, but also a case where a shift is carried out from a first lean-side air fuel ratio leaner than the stoichiometric air fuel ratio to a second lean-side air fuel ratio that is leaner than the stoichiometric air fuel ratio but richer than the first lean-side air fuel ratio. That is, in case where the air fuel ratio of the exhaust gas is shifted to a richer-side air fuel ratio by the exhaust gas air fuel ratio control section, the response time of the air fuel ratio sensor is detected by the stoichiometric air fuel ratio shift response time detection section.

A characteristic feature of the detection of the response time by the stoichiometric air fuel ratio shift response time detection section is that in the response period of the detection of the exhaust gas air fuel ratio by the air fuel ratio sensor, a difference between the detection times of two air fuel ratios, i.e., a first air fuel ratio and a second air fuel ratio which are equal to or leaner than the stoichiometric air fuel ratio, is set as the response time. This is to avoid, as much as possible, influences by the storage function of the NOx storage-reduction catalyst and a lean shift or deviation.

In addition, the detection of the detection time difference between the first air fuel ratio and the second air fuel ratio is not limited to a specific detection method. For example, when the air fuel ratio of the exhaust gas is shifted from a lean state to a rich state by the exhaust gas air fuel ratio control section, the detection time difference in the form of the response time may be obtained by setting an initial value of the air fuel ratio as the first air fuel ratio, and a certain air fuel ratio as the second air fuel ratio at a time point at which an air fuel ratio change of a prescribed rate has been made in a change of the exhaust gas air fuel ratio from the initial value to a final value.

Moreover, the detection time difference in the form of the response time may also be obtained by setting one air fuel ratio, as the first air fuel ratio, at a time point at which an air fuel ratio change of a prescribed first rate has been made, and another air fuel ratio, as the second air fuel ratio, at a time point at which an air fuel ratio change of a prescribed second rate has been made in the change of the air fuel ratio from the initial value to the final value when the air fuel ratio of the exhaust gas is shifted from the lean state to the rich state by the exhaust gas air fuel ratio control section.

As the air fuel ratio sensor elaborates, the response time detected by the stoichiometric air fuel ratio shift response time detection section tends to be longer. Accordingly, the air fuel ratio sensor deterioration determination section can make a more accurate determination as to whether the air fuel ratio sensor is degraded, by comparing the response time detected by the stoichiometric air fuel ratio shift response time detection section with a stoichiometric air fuel ratio shift reference time which serves as a reference or criteria for deterioration determination. Here, note that the stoichiometric air fuel ratio shift reference time is a response time in case where the air fuel ratio sensor is not degraded, or where the air fuel ratio sensor can detect the air fuel ratio of the exhaust gas without any problem even if somewhat degraded.

As can be seen from the above, in the above-mentioned air fuel ratio sensor deterioration determination system for a compression ignition internal combustion engine, it is possible to make a deterioration determination of the air fuel ratio sensor arranged at the downstream side of the NOx storage-reduction catalyst in a highly accurate manner.

Further, the control of the air fuel ratio of the exhaust gas by the exhaust gas air fuel ratio control section upon detection of the response time by the stoichiometric air fuel ratio shift response time detection section may be air fuel ratio control that is performed upon reduction of the NOx or release of the SOx occluded in the NOx storage-reduction catalyst. With this, it is possible to make a deterioration determination of the air fuel ratio sensor during ordinary exhaust gas purification control without particularly controlling the air fuel ratio of the exhaust gas only for the purpose of the deterioration determination of the air fuel ratio sensor.

Here, in the above-mentioned air fuel ratio sensor deterioration determination system for a compression ignition internal combustion engine according to the first aspect of the present invention, it is preferred that provision be made for a stoichiometric air fuel ratio shift reference time correction section that corrects the stoichiometric air fuel ratio shift reference time based on the air fuel ratio of the exhaust gas in the lean state before the air fuel ratio of the exhaust gas is controlled to the rich state by the exhaust gas air fuel ratio control section, or based on an exhaust gas travel time from a time point fuel is supplied to the exhaust gas by the exhaust gas air fuel ratio control section until a time point the exhaust gas reaches the air fuel ratio sensor.

That is, it is possible to make a much more accurate determination of the air fuel ratio sensor by correcting the stoichiometric air fuel ratio shift reference time to a more appropriate value in accordance with the operating state of the compression ignition internal combustion engine. Here, note that when the air fuel ratio of the exhaust gas is controlled by the exhaust gas air fuel ratio control section, the response time in the form of a difference between the detection times of the first air fuel ratio and the second air fuel ratio changes according to the initial value of the air fuel ratio of the exhaust gas. The leaner the initial value of the air fuel ratio of the exhaust gas, the larger does the width or range of the air fuel ratio varied by the exhaust gas air fuel ratio control section become, so the above response time becomes accordingly longer. In such a case, a correction to increase the stoichiometric air fuel ratio shift reference time is carried out by the stoichiometric air fuel ratio shift reference time correction section.

Furthermore, when the air fuel ratio of the exhaust gas is controlled by the exhaust gas air fuel ratio control section, in the actual compression ignition internal combustion engine, there exists an exhaust gas travel time, i.e., the time required until a change in the air fuel ratio of the exhaust gas induced by the exhaust gas air fuel ratio control section is reflected on the air fuel ratio sensor, and such an exhaust gas travel time varies according to the size, the flow rate of the exhaust gas, etc., of the compression ignition internal combustion engine. In addition, the above-mentioned response time becomes longer in the accordance with the increasing exhaust gas travel time. Accordingly, in this case, a correction to increase the stoichiometric air fuel ratio shift reference time is carried out by the stoichiometric air fuel ratio shift reference time correction section.

Secondly, in the present invention, attention is focussed on that when the air fuel ratio of an exhaust gas flowing into the NOx storage-reduction catalyst is shifted from a rich state to a lean state, the air fuel ratio of the exhaust gas detected by an air fuel ratio sensor is shifted to the lean state after having been temporarily maintained at a value in the vicinity of the stoichiometric air fuel ratio by the storage function of the NOx storage-reduction catalyst. In the process of the air fuel ratio of the exhaust gas being shifted from the rich state to the lean state, by determining the deterioration of the air fuel ratio sensor based on its response to the detection of the air fuel ratio by the air fuel ratio sensor at a time after the air fuel ratio of the exhaust gas is temporarily put into the value in the vicinity of the stoichiometric air fuel ratio by the storage function of the NOx storage-reduction catalyst, it is possible to make a more accurate deterioration determination.

Thus, according to a second aspect of the present invention, there is provided an air fuel ratio sensor deterioration determination system for a compression ignition internal combustion engine comprising: an NOx storage-reduction catalyst arranged on an exhaust passage of the compression ignition internal combustion engine; an air fuel ratio sensor arranged at a downstream side of the NOx storage-reduction catalyst for detecting an air fuel ratio corresponding to an oxygen concentration of an exhaust gas flowing out from the NOx storage-reduction catalyst; an exhaust gas air fuel ratio control section that controls an air fuel ratio of an exhaust gas flowing into the NOx storage-reduction catalyst by supplying fuel to the exhaust gas flowing into the NOx storage-reduction catalyst; a lean shift response time detection section that detects a response time from a time point the air fuel ratio sensor detects a third air fuel ratio, which is equal to or leaner than a stoichiometric air fuel ratio, to a time point the air fuel ratio sensor detects a fourth air fuel ratio, which is leaner than the third air fuel ratio, when the air fuel ratio of the exhaust gas being in a rich state is controlled to a lean state by the exhaust gas air fuel ratio control section; and an air fuel ratio sensor deterioration determination section that makes a determination that the air fuel ratio sensor is degraded, when the response time detected by the lean shift response time detection section exceeds a lean shift reference time.

In the above-mentioned compression ignition internal combustion engine, when the response time of the air fuel ratio sensor is detected by the lean shift response time detection section, the exhaust gas air fuel ratio control section shifts the air fuel ratio of the exhaust gas from the rich state to the lean state. This shift from the rich state to the lean state includes not only a case where a shift is done from a rich-side air fuel ratio richer than the stoichiometric air fuel ratio to a lean-side air fuel ratio leaner than the stoichiometric air fuel ratio, but also a case where a shift is carried out from a third lean-side air fuel ratio equal to or leaner than the stoichiometric air fuel ratio to a fourth lean-side air fuel ratio that is leaner than the third air fuel ratio. That is, in case where the air fuel ratio of the exhaust gas is shifted to a leaner-side air fuel ratio by the exhaust gas air fuel ratio control section, the response time of the air fuel ratio sensor is detected by the lean shift response time detection section.

Here, not that a characteristic feature of the detection of the response time by the lean shift response time detection section is that in the response period of the detection of the exhaust gas air fuel ratio by the air fuel ratio sensor, a difference between the detection times of two air fuel ratios, i.e., a first air fuel ratio and a second air fuel ratio which are equal to or leaner than the stoichiometric air fuel ratio is set as the response time. This is to avoid, as much as possible, influences by the storage function of the NOx storage-reduction catalyst and a lean shift or deviation.

In addition, the detection of the detection time difference between the third air fuel ratio and the fourth air fuel ratio is not limited to a specific detection method, as in the case of the detection of the detection time difference between the first air fuel ratio and the second air fuel ratio.

As the air fuel ratio sensor degrades or deteriorates, the response time detected by the lean shift response time detection section tends to be longer. Accordingly, the air fuel ratio sensor deterioration determination section can make a more accurate determination as to whether the air fuel ratio sensor is degraded, by comparing the response time detected by the lean shift response time detection section with a lean shift reference time which serves as a reference or criteria for deterioration determination. Here, the lean shift reference time is a response time in case where the air fuel ratio sensor is not degraded, or where the air fuel ratio sensor can detect the air fuel ratio of the exhaust gas without any problem even if somewhat degraded.

As can be seen from the above, in the above-mentioned air fuel ratio sensor deterioration determination system for a compression ignition internal combustion engine, it is possible to make a deterioration determination of the air fuel ratio sensor arranged at the downstream side of the NOx storage-reduction catalyst in a highly accurate manner.

Moreover, the control of the air fuel ratio of the exhaust gas by the exhaust gas air fuel ratio control section upon detection of the response time by the lean shift response time detection section may be air fuel ratio control that is performed upon reduction of the NOx or release of the SOx occluded in the NOx storage-reduction catalyst. With this, it is possible to make a deterioration determination of the air fuel ratio sensor during ordinary exhaust gas purification control without particularly controlling the air fuel ratio of the exhaust gas only for the purpose of the deterioration determination of the air fuel ratio sensor.

Further, in the above-mentioned air fuel ratio sensor deterioration determination system for a compression ignition internal combustion engine according to the second aspect of the present invention, it is preferred that provision be made for a lean shift reference time correction section that corrects the lean shift reference time based on the air fuel ratio of the exhaust gas in a lean state when the air fuel ratio of the exhaust gas is controlled to the lean state by the exhaust gas air fuel ratio control section, or based on an exhaust gas travel time from a time point the amount of fuel supplied to the exhaust gas by the exhaust gas air fuel ratio control section is reduced until a time point the exhaust gas reaches the air fuel ratio sensor.

That is, it is possible to make a much more accurate determination of the air fuel ratio sensor by correcting the lean shift reference time to a more appropriate value in accordance with the operating state of the compression ignition internal combustion engine. Here, note that when the air fuel ratio of the exhaust gas is controlled by the exhaust gas air fuel ratio control section, the response time in the form of a difference between the detection times of the third air fuel ratio and the fourth air fuel ratio changes according to the final value of the exhaust gas air fuel ratio. The leaner the final value of the air fuel ratio of the exhaust gas, the larger does the width or range of the air fuel ratio varied by the exhaust gas air fuel ratio control section become, so the above response time becomes accordingly longer. In such a case, a correction to increase the lean shift reference time is carried out by the lean shift reference time correction section.

Furthermore, the amount of fuel supplied to the exhaust gas is decreased (including the stop of the supply) by the exhaust gas air fuel ratio control section, whereby the air fuel ratio of the exhaust gas is controlled to be in a lean state. Here, in the actual compression ignition internal combustion engine, there exists an exhaust gas travel time, i.e., the time required until a change in the air fuel ratio of the exhaust gas induced by the exhaust gas air fuel ratio control section is reflected on the air fuel ratio sensor, and such an exhaust gas travel time varies according to the size, the flow rate of the exhaust gas, etc., of the compression ignition internal combustion engine. Additionally, the above-mentioned response time becomes longer in the accordance with the increasing exhaust gas travel time. Accordingly, in this case, a correction to increase the lean shift reference time is carried out by the lean shift reference time correction section.

Here, in the above-mentioned air fuel ratio sensor deterioration determination system for a compression ignition internal combustion engine according to the second aspect of the present invention, it is preferred that the detection of the response time by the lean shift response detection section be carried out at the time when an amount of fuel supplied to the exhaust gas is reduced to control the air fuel ratio of the exhaust gas to a lean state by the exhaust gas air fuel ratio control section after the air fuel ratio of the exhaust gas detected by the air fuel ratio sensor becomes an air fuel ratio richer than the stoichiometric air fuel ratio.

With such an arrangement, the detection of the response time by the lean shift response time detection section is carried out after oxygen has been occluded again into the interior of the NOx storage-reduction catalyst by means of the storage function thereof from a state in which the amount of oxygen occluded in the NOx storage-reduction catalyst is small. As a result, the storage function of the NOx storage-reduction catalyst can be excluded as much as possible in the detection of the response time.

The above and other objects, features and advantages of the present invention will become more readily apparent to those skilled in the art from the following detailed description of preferred embodiments of the present invention taken in conjunction with the accompanying drawings.

BEST MODE FOR CARRYING OUT THE INVENTION

Hereinafter, a preferred embodiment of an air fuel ratio sensor deterioration determination system for a compression ignition internal combustion engine according to the present invention will be described in detail while referring to the accompanying drawings.

Figure 1:
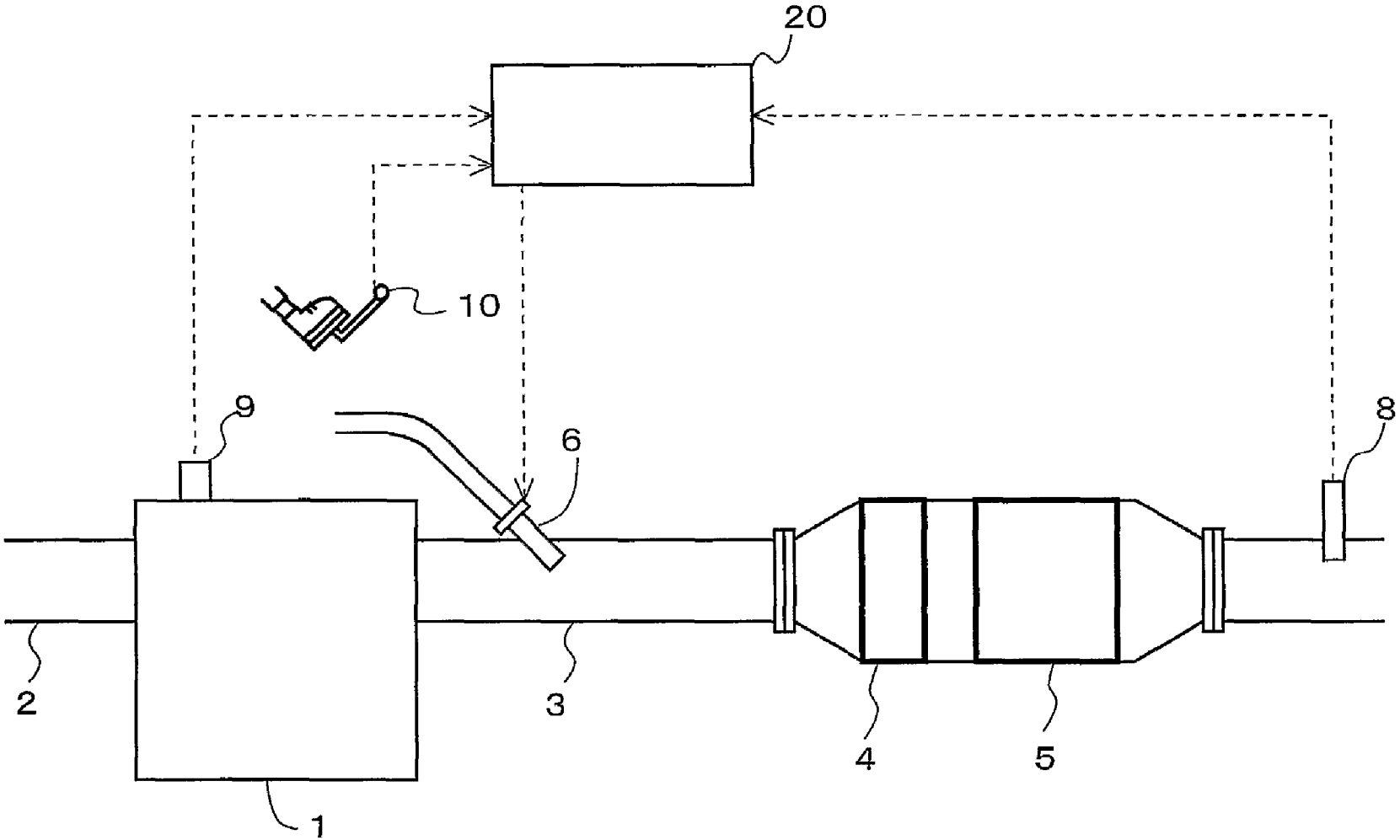
FIG. 1 is a view showing the schematic construction of an air fuel ratio sensor deterioration determination system for a compression ignition internal combustion engine according to one embodiment of the present invention.

FIG. 1 is a block diagram that shows the schematic construction of the air fuel ratio sensor deterioration determination system for a compression ignition internal combustion engine 1 (hereinafter referred to simply as an "internal combustion engine") to which the present invention is applied. Here, the internal combustion engine 1 is a compression ignition type internal combustion engine. An intake passage 2 is connected with a combustion chamber in each cylinder of the internal combustion engine 1, and an exhaust gas generated by combustion of an air fuel mixture in each combustion chamber of the internal combustion engine 1 is discharged therefrom into an exhaust passage 3. On the exhaust passage 3, there are arranged an oxidation catalyst 4 having an oxidizing function or ability, and a so-called NOx storage-reduction catalyst 5 (hereinafter referred to as a "NOx catalyst") downstream of the oxidation catalyst 4. Here, note that the NOx catalyst 5 contains platinum in its composition, and hence acts as a catalyst having an oxidizing function or ability. A fuel addition valve 6 for adding fuel for the internal combustion engine 1, which acts as a reducing agent, to the exhaust gas flowing through the exhaust passage 3 is mounted on the exhaust passage 3 at a location upstream of the oxidation catalyst 4. The fuel added from the fuel addition valve 6 to the exhaust gas is supplied to the oxidation catalyst 4 and the NOx catalyst 5, so that it acts as a reducing agent with respect to these catalysts, and is oxidized by the oxidizing functions of these catalysts to generate oxidation heat.

An electronic control unit (hereinafter referred to as an "ECU") 20 for controlling the internal combustion engine 1 is provided in conjunction with the engine 1. This ECU 20 is provided with a CPU and storage elements such as a ROM, a RAM, etc., for storing various programs, maps, etc., to be described later, and it is a unit for controlling the operating state or the like of the internal combustion engine 1 in accordance with the operating condition of the internal combustion engine 1 and driver's requirements.

Various sensors such as a crank position sensor 9, an accelerator opening sensor 10, etc., for detecting the operating state of the internal combustion engine 1 are connected to the ECU 20 through electric wiring, so that the output signals from these sensors are input to the ECU 20 which can detect the rotational speed and the engine load of the internal combustion engine 1. In addition, an air fuel ratio sensor 8 arranged at the downstream side of the NOx catalyst 5 is electrically connected to the ECU 20. The ECU 20 can detect the air fuel ratio of the exhaust gas flowing out from the NOx catalyst 5 by means of the air fuel ratio sensor 8.

On the other hand, the fuel addition valve 6 is connected to the ECU 20 through electric wiring, so that the amount of fuel added from the fuel addition valve 6 to the exhaust gas flowing through the exhaust passage 3 is controlled according to a command from the ECU 20. In addition, though not illustrated in FIG. 1, fuel injection valves provided on the internal combustion engine 1 are also electrically connected to the ECU 20, so that the timing and amount of fuel injection from each fuel injection valve are controlled according to commands from the ECU 20.

In the internal combustion engine 1 as constructed in this manner, the oxidation catalyst 4 serves to oxidize the fuel in the exhaust gas to generate oxidation heat whereby the temperature of the exhaust gas flowing into the NOx catalyst 5 is raised. As a result, the temperature of the NOx catalyst 5 is raised to exert its exhaust gas purification ability due to the catalytic function thereof. The NOx catalyst 5 serves to occlude the NOx in the exhaust gas when the oxygen concentration of the exhaust gas flowing into the NOx catalyst 5 is high, and to release the NOx occluded therein when the oxygen concentration of the exhaust gas decreases. The released NOx is reduced to purify the exhaust gas by making use of the fuel added to the exhaust gas by the fuel addition valve 6 as a reducing agent. At this time, the air fuel ratio of the exhaust gas is adjusted to an appropriate value suitable for reduction of NOx, so the amount of fuel to be added from the fuel addition valve 6 is properly adjusted based on a detection signal from the air fuel ratio sensor 8.

However, the detection performance of the air fuel ratio sensor 8 is degraded or deteriorated because of particulate materials in the exhaust gas being adhered to the surface of the air fuel ratio sensor 8 in accordance with the use thereof. When the amount of fuel to be added from the fuel addition valve 6 is controlled based on the detection signal from the air fuel ratio sensor 8 thus degraded or deteriorated, the air fuel ratio of the exhaust gas does not become appropriate for reduction of the NOx or the added fuel is released into the atmosphere, resulting in a deterioration of the exhaust emission. Accordingly, it is necessary to determine the deterioration of the air fuel ratio sensor 8 in an accurate manner, and in some cases, it is necessary to notify the deterioration of the air fuel ratio sensor 8 to the driver of a vehicle on which the internal combustion engine 1 is installed.

Figure 2:
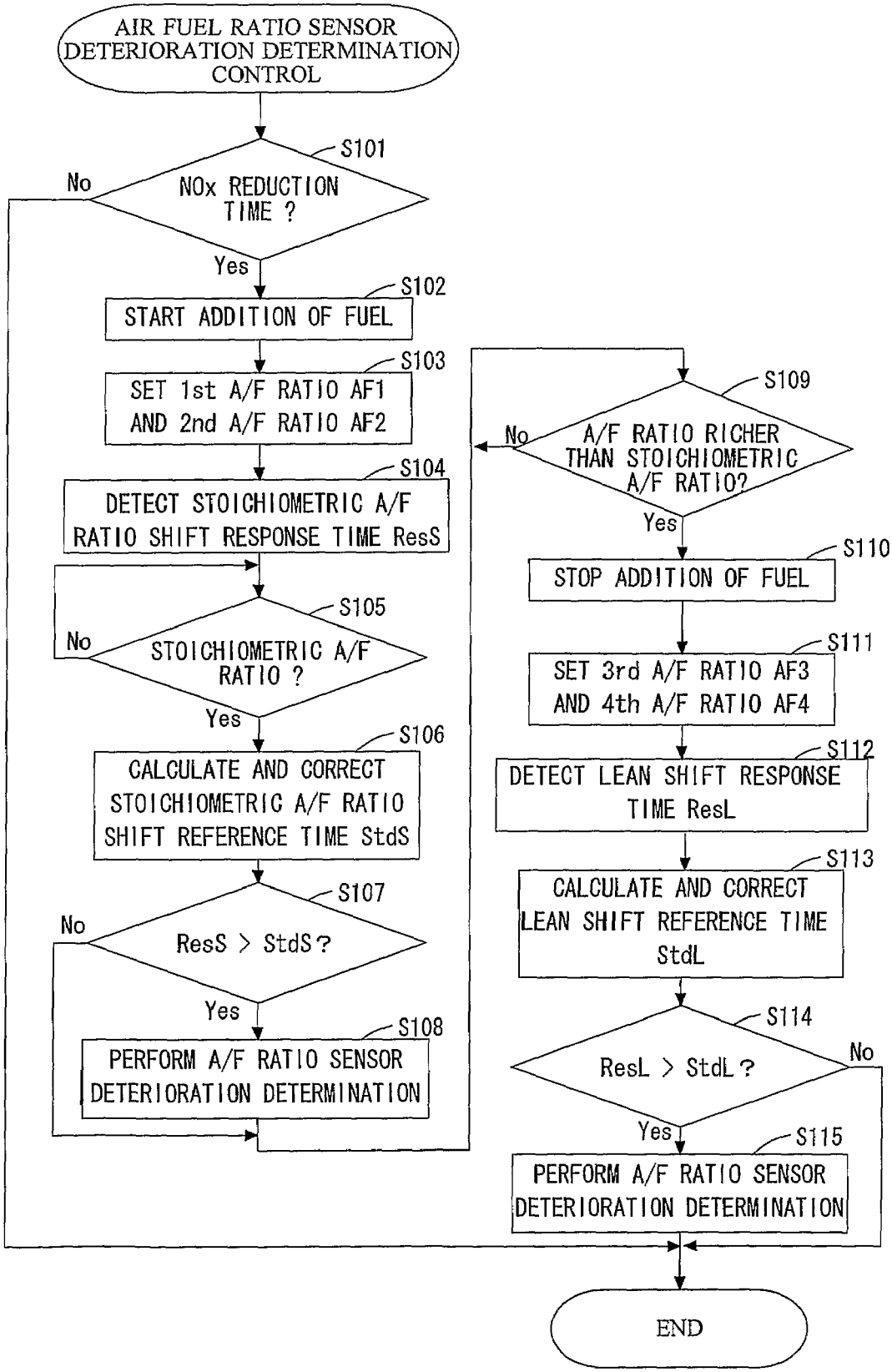
FIG. 2 is a flow chart related to air fuel ratio sensor deterioration determination control executed in the air fuel ratio sensor deterioration determination system for a compression ignition internal combustion engine according to the embodiment of the present invention.

Thus, reference will be made to the control for determining the deterioration of the air fuel ratio sensor 8 (hereinafter referred to as "air fuel ratio sensor deterioration determination control") based on FIG. 2. The air fuel ratio sensor deterioration determination control is to determine the deterioration of the air fuel ratio sensor 8 from the response in the air fuel ratio detection of the air fuel ratio sensor 8 when the amount of fuel to be added from the fuel addition valve 6 is adjusted so as to control the air fuel ratio of the exhaust gas. Hereinafter, a detailed explanation thereof will be given. In this connection, note that the air fuel ratio sensor deterioration determination control shown in FIG. 2 is a routine that is repeatedly executed by the ECU 20 at a prescribed cycle.

In step S101, in the internal combustion engine 1, it is determined whether it is the time when the NOx occluded in the NOx catalyst 5 is to be reduced. For example, when a predetermined time has elapsed after the last reduction of the occluded NOx, a determination may be made that it is the time when the NOx is to be reduced. When determined that it is the time when the NOx is to be reduced, the control flow proceeds to step S102, whereas when determined that it is not the time, this control is terminated.

In step S102, the addition of fuel from the fuel addition valve 6 is started so as to reduce the NOx occluded in the NOx catalyst 5. As a result, the air fuel ratio of the exhaust gas flowing into the NOx catalyst 5 is changed from a lean state into a rich state, so the NOx occluded in the NOx catalyst 5 is reduced by the fuel component of the exhaust gas. When the processing in step S103 has been terminated, the control flow goes to step S103.

Figure 3:
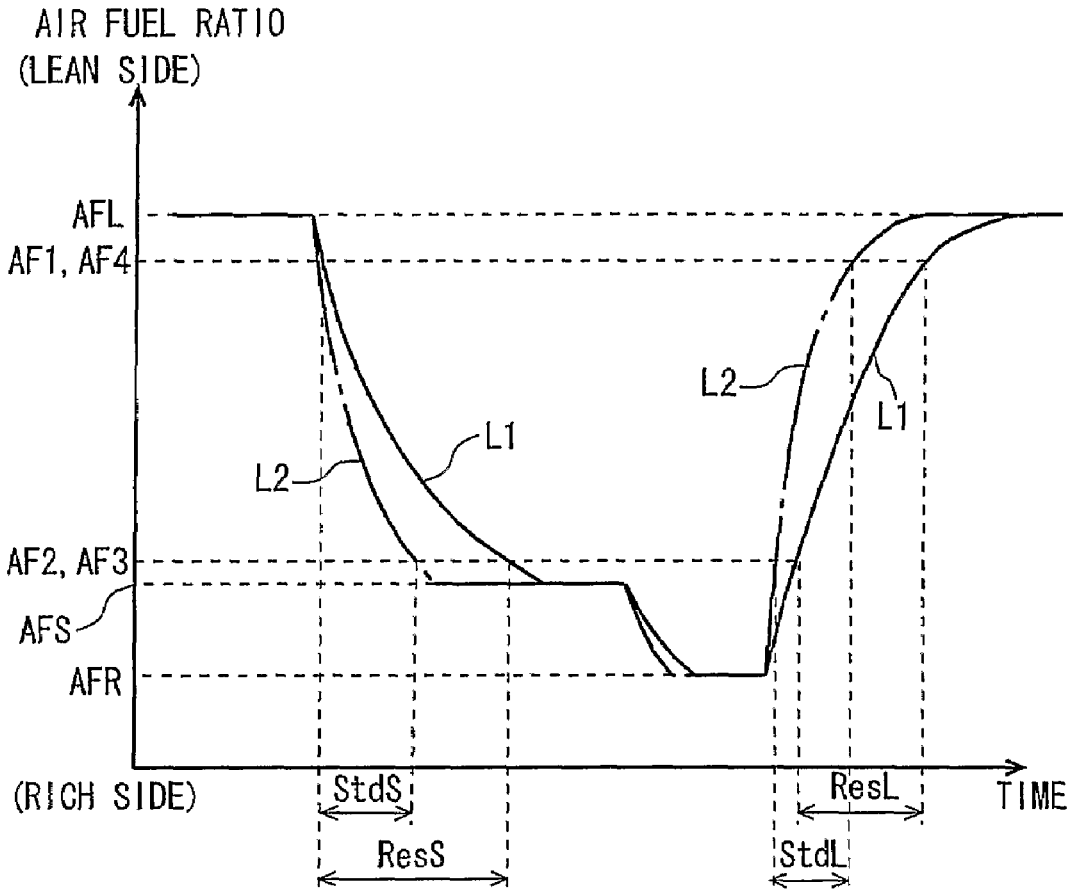
FIG. 3 is a view showing the change of the air fuel ratio of an exhaust gas detected by an air fuel ratio sensor in the air fuel ratio sensor deterioration determination system for a compression ignition internal combustion engine according to the embodiment of the present invention.

Here, FIG. 3 illustrates the change of the air fuel ratio of the exhaust gas detected by the air fuel ratio sensor 8 when the air fuel ratio sensor deterioration determination control according to this embodiment is carried out (i.e., the change represented by line L1 (solid line) in FIG. 3). A change represented by line L2 (alternate long and short dash line) in FIG. 3 is the change of the air fuel ratio of the exhaust gas when it is assumed that the air fuel ratio sensor 8 is not degraded. The air fuel ratio of the exhaust gas before the addition of fuel in S102 is performed is of a value AFL which is leaner than the stoichiometric air fuel ratio (the air fuel ratio represented by AFS in FIG. 3), and when the addition of fuel in S102 is carried out, the air fuel ratio of the exhaust gas shifts gradually toward the stoichiometric air fuel ratio AFS.

Then, in step S103, a first air fuel ratio AF1 and a second air fuel ratio AF2 are set. The first air fuel ratio AF1 and the second air fuel ratio AF2 are represented by AF1 and AF2, respectively, in FIG. 3. Here, though the air fuel ratio of the exhaust gas is shifted from AFL to AFS according to the starting of the fuel addition in step S102, the first air fuel ratio AF1 in the transition or shifting process of the air fuel ratio of the exhaust gas means an air fuel ratio in a shift level stage of 10%, and the second air fuel ratio AF2 means an air fuel ratio in a shift level stage of 90%. When the processing in step S103 has been terminated, the control flow goes to step S104.

In step S104, a response time ResS at the time when the exhaust gas air fuel ratio is shifted from AFL to AFS (hereinafter referred to as "at the time of shifting to the stoichiometric air fuel ratio") is detected. Specifically, the time elapsed from a first time point at which the above first air fuel ratio AF1 was detected until a second time point at which the above second air fuel ratio AF2 is detected by the air fuel ratio sensor 8 is set as the response time ResS. When the processing in step S104 has been terminated, the control flow goes to step S105.

In step S105, it is determined whether the air fuel ratio of the exhaust gas detected by the air fuel ratio sensor 8 is the stoichiometric air fuel ratio AFS. That is, it is determined whether the air fuel ratio of the exhaust gas flowing out from the NOx catalyst 5 with fuel being added by the fuel addition valve 6 is substantially constantly adjusted to the stoichiometric air fuel ratio AFS by the storage function of the NOx catalyst 5. When it is determined that the air fuel ratio of the exhaust gas is the stoichiometric air fuel ratio AFS, the control flow advances to step S106, whereas when it is determined that the air fuel ratio of the exhaust gas is not the stoichiometric air fuel ratio AFS, the processing in step S105 is carried out again.

In step S106, a stoichiometric air fuel ratio shift reference time StdS, which becomes a reference or criteria at the time of shifting to the stoichiometric air fuel ratio and is the response time of the exhaust gas air fuel ratio detected by the air fuel ratio sensor 8, is calculated and corrected based on prescribed parameters. The stoichiometric air fuel ratio shift reference time StdS is a response time required for the exhaust gas air fuel ratio to shift from AFL to AFS in case where the air fuel ratio sensor 8 is not degraded. In FIG. 3, the time elapsed after the detection of the first air fuel ratio AF1 until the detection of the second air fuel ratio AF2 when the detection characteristic of the air fuel ratio sensor 8 exhibits the change of the exhaust gas air fuel ratio represented by line L2 corresponds to the stoichiometric air fuel ratio shift reference time StdS. Regarding the stoichiometric air fuel ratio shift reference time StdS, a relation between the first air fuel ratio AF1 and the second air fuel ratio AF2 is beforehand measured by experiments or the like, and various other relations are stored in map forms in the ECU 20, so that the stoichiometric air fuel ratio shift reference time StdS is calculated by accessing the maps while using the first air fuel ratio AF1 and the second air fuel ratio AF2 as parameters.

Further, the response time required for the exhaust gas air fuel ratio to shift from AFL to AFS varies according to the values of prescribed parameters. For example, the leaner the air fuel ratio AFL before the addition of fuel in S102 is started, the longer does the response time become. In addition, some time (hereinafter referred to as an "exhaust gas travel time") will be required for the fuel added from the fuel addition valve 6 to the exhaust gas to reach the air fuel ratio sensor 8 while passing through the exhaust passage 3, the oxidation catalyst 4 and the NOx catalyst 5. This exhaust gas travel time is influenced by the length of the exhaust passage 3, the capacity of the NOx catalyst 5, the flow rate of the exhaust gas flowing through the exhaust passage 3, etc. Accordingly, the stoichiometric air fuel ratio shift reference time StdS calculated from the maps as stated above is corrected in consideration of these parameters. When the processing in step S106 has been terminated, the control flow proceeds to step S107.

In step S107, a comparison is made between the stoichiometric air fuel ratio shift response time ResS calculated in step S104 and the stoichiometric air fuel ratio shift reference time StdS calculated and corrected in step S106, and when it is determined that the stoichiometric air fuel ratio shift response time ResS exceeds the stoichiometric air fuel ratio shift reference time StdS, the control flow advances to step S108. On the other hand, when it is determined in step S107 that the stoichiometric air fuel ratio shift response time ResS is less than or equal to the stoichiometric air fuel ratio shift reference time StdS, the control flow advances to step S109.

In step S108, in view of the fact that it has been determined in step S107 that the stoichiometric air fuel ratio shift response time ResS exceeds the stoichiometric air fuel ratio shift reference time StdS, a determination is made that the air fuel ratio sensor 8 is in a state of deterioration. That is, it is possible to determine the degree of deterioration of the air fuel ratio sensor 8 in a more accurate manner by using the fact that the response time of the exhaust gas air fuel ratio detected under the condition that is less prone to be influenced by the storage function of the NOx catalyst 5 increases in accordance with the increased degree of deterioration of the air fuel ratio sensor 8. When the processing in step S108 has been terminated, the control flow goes to step S109.

In step S109, it is determined whether the air fuel ratio of the exhaust gas detected by the air fuel ratio sensor 8 is the rich-side air fuel ratio AFR richer than the stoichiometric air fuel ratio AFS. When determined that the exhaust gas air fuel ratio is AFR, the control flow proceeds to step S110, whereas when determined that the exhaust gas air fuel ratio is not AFR, the processing in step S109 is carried out again.

In step S110, in view of the determination in step S109 that the exhaust gas air fuel ratio is AFR, it is determined that the processing of reducing the NOx occluded in the NOx catalyst 5 has been terminated, and the addition of fuel from the fuel addition valve 6 is stopped. As a result, the air fuel ratio detected by the air fuel ratio sensor 8 shifts from AFR to the lean-side air fuel ratio AFL through the stoichiometric air fuel ratio AFS. When the processing in step S110 has been terminated, the control flow goes to step S111.

In step S111, a third air fuel ratio AF3 and a fourth air fuel ratio AF4 are set. Here, note that the third air fuel ratio AF3 and the fourth air fuel ratio AF4 are represented as AF3 and AF4, respectively, in FIG. 3, and are identical with the second air fuel ratio AF2 and the first air fuel ratio AF1, respectively, and both of them are leaner than the stoichiometric air fuel ratio AFS. When the processing in step S111 has been terminated, the control flow goes to step S112.

In step S112, a response time ResL at the time when the exhaust gas air fuel ratio is shifted from AFS to AFL (hereinafter referred also to as "at the time of lean shift") is detected. Specifically, the time elapsed from a third time point at which the above third air fuel ratio AF3 was detected until a fourth time point at which the above fourth air fuel ratio AF4 is detected by the air fuel ratio sensor 8 is set as the response time ResL. When the processing in step S112 has been terminated, the control flow goes to step S113.

In step S113, a lean shift reference time StdL, which becomes a reference or criteria at the time of lean shift and is the response time of the exhaust gas air fuel ratio detected by the air fuel ratio sensor 8, is calculated and corrected based on prescribed parameters. The lean shift reference time StdL is a response time required for the exhaust gas air fuel ratio to shift from AFS to AFL in case where the air fuel ratio sensor 8 is not degraded. In FIG. 3, the time elapsed after the detection of the third air fuel ratio AF3 until the detection of the fourth air fuel ratio AF4 when the detection characteristic of the air fuel ratio sensor 8 exhibits the change of the exhaust gas air fuel ratio represented by line L2 corresponds to the lean shift reference time StdL. Regarding the lean shift reference time StdL, a relation between the third air fuel ratio AF3 and the fourth air fuel ratio AF4 is beforehand measured by experiments or the like, and various other relations are stored in map forms in the ECU 20, so that the lean shift reference time StdL is calculated by accessing the maps while using the third air fuel ratio AF3 and the fourth air fuel ratio AF4 as parameters.

Further, the response time required for the exhaust gas air fuel ratio to shift from AFS to AFL varies according to the values of prescribed parameters, as described above. Accordingly, the lean shift reference time StdL calculated from the maps as stated above is corrected in consideration of these parameters. When the processing in step S113 has been terminated, the control flow goes to step S114.

In step S114, a comparison is made between the lean shift response time ResL calculated in step S112 and the lean shift reference time StdL calculated and corrected in step S113, and when it is determined that the lean shift response time ResL exceeds the lean shift reference time StdL, the control flow advances to S115, whereas when it is determined that the lean shift response time ResL is less than or equal to the lean shift reference time StdL, this control is terminated.

In step S115, in view of the face that it has been determined in step S114 that the lean shift response time ResL exceeds the stoichiometric air fuel ratio shift reference time StdL, a determination is made that the air fuel ratio sensor 8 is in a state of deterioration. That is, the degree of deterioration of the air fuel ratio sensor 8 can be determined in a more accurate manner by using the fact that the response time of the exhaust gas air fuel ratio detected under the condition that is less prone to be influenced by the storage function of the NOx catalyst 5 increases in accordance with the increased degree of deterioration of the air fuel ratio sensor 8. After the processing in step S115, this control is terminated.

Figure 4:
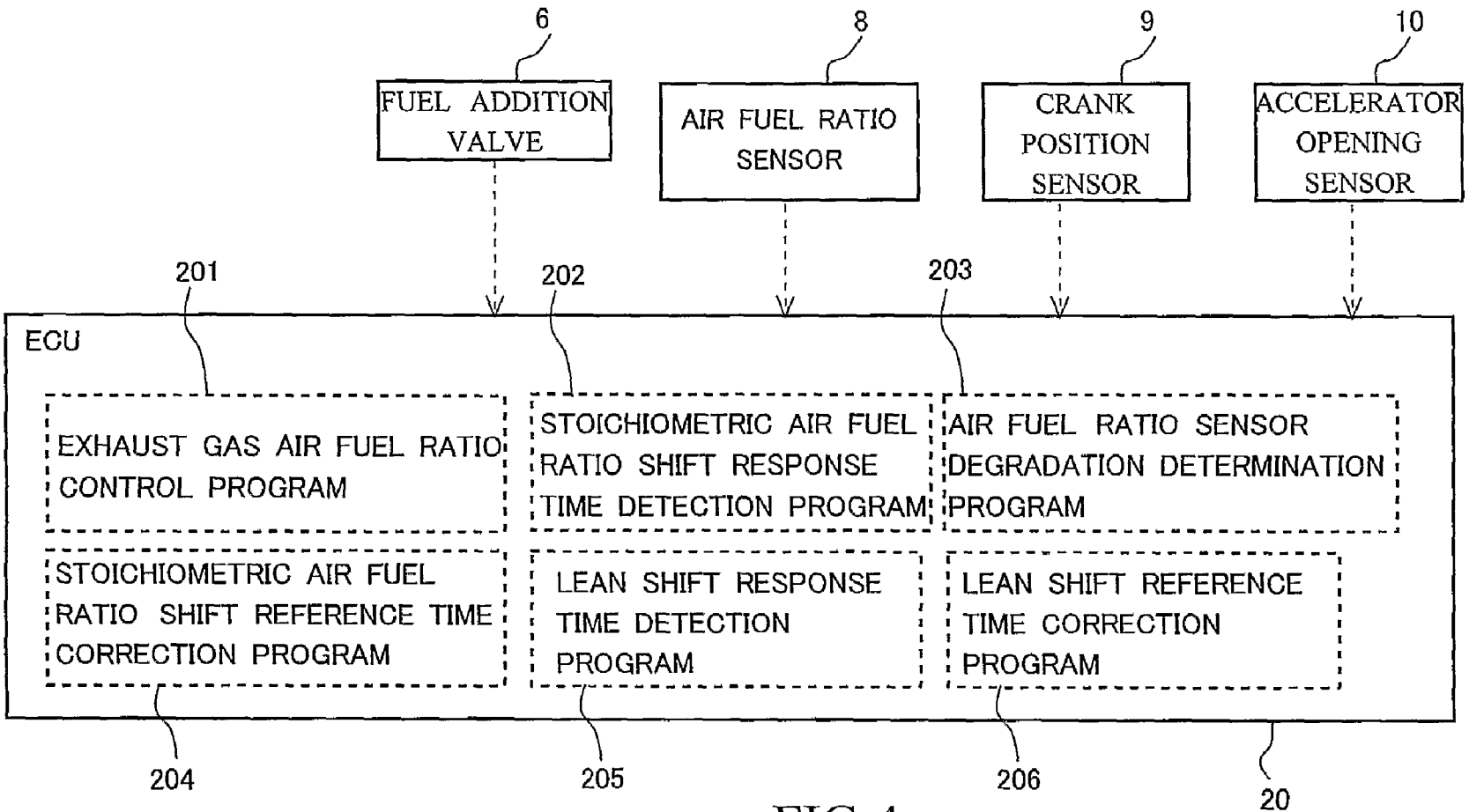
FIG. 4 is a view schematically showing control blocks of the air fuel ratio sensor deterioration determination system for a compression ignition internal combustion engine according to the embodiment of the present invention.

Here, note that in respect of this control, control programs shown in FIG. 4 are stored in the ECU 20. Specifically, an exhaust gas air fuel ratio control program 201 (i.e., a control program that performs the processing in steps S101 and S102 of this control) for controlling the air fuel ratio of the exhaust gas flowing into the NOx catalyst 5 is stored in the ECU 20, and this program constitutes an exhaust gas air fuel ratio control section according to the present invention. Also, a stoichiometric air fuel ratio shift response time detection program 202 (i.e., a control program that performs the procession in steps S103 and S104 of this control) for detecting the time required for the air fuel ratio of the exhaust gas to change from the first air fuel ratio the second air fuel ratio according to the present invention is stored in the ECU 20, and this program constitutes a stoichiometric air fuel ratio shift response time detection section according to the present invention. In addition, a lean shift response time detection program 205 (i.e., a control program that performs the processing in steps S111 and S112 of this control) for detecting the time required for the air fuel ratio of the exhaust gas to change from the third air fuel ratio to the fourth air fuel ratio according to the present invention is stored in the ECU 20, and this program constitutes a lean shift response time detection section according to the present invention.

In addition, an air fuel ratio sensor deterioration determination program 203 (i.e., a control program that performs the processing in steps S107, S108, S114 and S115 of this control) for determining the deterioration of the air fuel ratio sensor 8 based on the response time detected by the stoichiometric air fuel ratio shift response time detection program 202 or the response time detected by the lean shift response time detection program 205 is stored in the ECU 20, and this program constitutes an air fuel ratio sensor deterioration determination section according to the present invention.

Further, a stoichiometric air fuel ratio shift reference time correction program 204 (i.e., a control program that performs processing in step S106 of this control) for correcting the stoichiometric air fuel ratio shift reference time StdS, which is a determination reference for the air fuel ratio sensor deterioration determination program 203, and a lean shift reference time correction program 206 (i.e., a control program that performs the processing in step S113 of this control) for correcting the lean shift reference time StdL are stored in the ECU 20, and these programs constitute a stoichiometric air fuel ratio shift reference time correction section and a lean shift reference time correction section, respectively, according to the present invention.

According to this control, the deterioration of the air fuel ratio sensor 8 can be determined based on a variation of the exhaust gas air fuel ratio that is inevitably generated in the process of performing the reduction of the NOx occluded in the NOx catalyst 5. In addition, by making the deterioration determination of the air fuel ratio sensor 8 based on a shift of the air fuel ratio to the stoichiometric air fuel ratio or to a lean-side air fuel ratio leaner than the stoichiometric air fuel ratio, it is possible to avoid deterioration in accuracy of the deterioration determination due to the storage function of the NOx catalyst 5, as a consequence of which a more accurate deterioration determination of the air fuel ratio sensor 8 can be carried out.

In this embodiment, the elapsed time between the first air fuel ratio AF1 and the second air fuel ratio AF2 or the elapsed time between the third air fuel ratio AF3 and the fourth air fuel ratio AF4 is set as the response time at the time of shifting to the stoichiometric air fuel ratio or at the time of lean shift. However, in place of these, a time required at a time point at which a predetermined ratio of the shift width or range of the exhaust gas air fuel ratio (e.g., an amount of variation of the air fuel ratio between AFL and AFS in this embodiment) at the time of shifting to the stoichiometric air fuel ratio or at the time of lean shift has elapsed, for example, a time required (time constant) when a 63% response has been made for calculating a time constant in step response during general control may be used as the response time in this embodiment.

Although in this embodiment, the deterioration determination of the air fuel ratio sensor 8 is performed when the NOx occluded in the NOx catalyst 5 is reduced, such a deterioration determination is not limited to this case, but may be carried out, for example, when fuel is added from the fuel addition valve 6 so as to release the SOx occluded in the NOx catalyst 5.

INDUSTRIAL APPLICABILITY

In an air fuel ratio sensor deterioration determination system for a compression ignition internal combustion engine according to the present invention, it is possible to highly accurately perform a deterioration determination of an air fuel ratio sensor, which is arranged at a downstream side of an NOx storage-reduction catalyst provided on an exhaust system of the compression ignition internal combustion engine.

The invention claimed is:

1. An air fuel ratio sensor deterioration determination system for a compression ignition internal combustion engine comprising:

an NOx storage-reduction catalyst arranged on an exhaust passage of said compression ignition internal combustion engine;

an air fuel ratio sensor arranged at a downstream side of said NOx storage-reduction catalyst for detecting an air fuel ratio corresponding to an oxygen concentration of an exhaust gas flowing out from said NOx storage-reduction catalyst;

an exhaust gas air fuel ratio control section that controls an air fuel ratio of an exhaust gas flowing into said NOx storage-reduction catalyst by supplying fuel to said exhaust gas flowing into said NOx storage-reduction catalyst;

a stoichiometric air fuel ratio shift response time detection section that detects a response time from a time point said air fuel ratio sensor detects a first air fuel ratio, which is leaner than a stoichiometric air fuel ratio, to a time point said air fuel ratio sensor detects a second air fuel ratio, which is leaner than the stoichiometric air fuel ratio and richer than said first air fuel ratio, when the air fuel ratio of said exhaust gas being in a lean state is controlled to a rich state by said exhaust gas air fuel ratio control section; and an air fuel ratio sensor deterioration determination section that makes a determination that said air fuel ratio sensor is degraded, when the response time detected by said stoichiometric air fuel ratio shift response time detection section exceeds a stoichiometric air fuel ratio shift reference time.

2. The air fuel ratio sensor deterioration determination system for a compression ignition internal combustion engine as set forth in claim 1, further comprising:

a stoichiometric air fuel ratio shift reference time correction section that corrects said stoichiometric air fuel ratio shift reference time based on the air fuel ratio of the exhaust gas in said lean state before the air fuel ratio of the exhaust gas is controlled to said rich state by said exhaust gas air fuel ratio control section, or based on an exhaust gas travel time from a time point fuel is supplied to the exhaust gas by said exhaust gas air fuel ratio control section until a time point said exhaust gas reaches said air fuel ratio sensor.

3. An air fuel ratio sensor deterioration determination system for a compression ignition internal combustion engine comprising:

an NOx storage-reduction catalyst arranged on an exhaust passage of said compression ignition internal combustion engine;

an air fuel ratio sensor arranged at a downstream side of said NOx storage-reduction catalyst for detecting an air fuel ratio corresponding to an oxygen concentration of an exhaust gas flowing out from said NOx storage-reduction catalyst;

an exhaust gas air fuel ratio control section that controls an air fuel ratio of an exhaust gas flowing into said NOx storage-reduction catalyst by supplying fuel to said exhaust gas flowing into said NOx storage-reduction catalyst;

a lean shift response time detection section that detects a response time from a time point said air fuel ratio sensor detects a third air fuel ratio, which is leaner than a stoichiometric air fuel ratio, to a time point said air fuel ratio sensor detects a fourth air fuel ratio, which is leaner than said third air fuel ratio, when the air fuel ratio of said exhaust gas being in a rich state is controlled to a lean state by said exhaust gas air fuel ratio control section; and an air fuel ratio sensor deterioration determination section that makes a determination that said air fuel ratio sensor is degraded, when the response time detected by said lean shift response time detection section exceeds a lean shift reference time.

4. The air fuel ratio sensor deterioration determination system for a compression ignition internal combustion engine as set forth in claim 3, further comprising:

a lean shift reference time correction section that corrects said lean shift reference time based on the air fuel ratio of the exhaust gas in a lean state when the air fuel ratio of the exhaust gas is controlled to said lean state by said exhaust gas air fuel ratio control section, or based on an exhaust gas travel time from a time point the amount of fuel supplied to the exhaust gas by said exhaust gas air fuel ratio control section is reduced until a time point said exhaust gas reaches said air fuel ratio sensor.

5. The air fuel ratio sensor deterioration determination system for a compression ignition internal combustion engine as set forth in claim 3, wherein the detection of the response time by said lean shift response detection section is carried out at the time when an amount of fuel supplied to the exhaust gas is reduced to control the air fuel ratio of the exhaust gas to a lean state by said exhaust gas air fuel ratio control section after the air fuel ratio of the exhaust gas detected by said air fuel ratio sensor becomes an air fuel ratio richer than the stoichiometric air fuel ratio.

6. The air fuel ratio sensor deterioration determination system for a compression ignition internal combustion engine as set forth in claim 1, wherein the control of the air fuel ratio of the exhaust gas by said exhaust gas air fuel ratio control section is air fuel ratio control for reducing the NOx occluded in said NOx storage-reduction catalyst or releasing the SOx occluded therein.

7. The air fuel ratio sensor deterioration determination system for a compression ignition internal combustion engine as set forth in claim 4, wherein the detection of the response time by said lean shift response detection section is carried out at the time when an amount of fuel supplied to the exhaust gas is reduced to control the air fuel ratio of the exhaust gas to a lean state by said exhaust gas air fuel ratio control section after the air fuel ratio of the exhaust gas detected by said air fuel ratio sensor becomes an air fuel ratio richer than the stoichiometric air fuel ratio.

8. The air fuel ratio sensor deterioration determination system for a compression ignition internal combustion engine as set forth in claim 2, wherein the control of the air fuel ratio of the exhaust gas by said exhaust gas air fuel ratio control section is air fuel ratio control for reducing the NOx occluded in said NOx storage-reduction catalyst or releasing the SOx occluded therein.

* * * * *